US007612646B2

(12) United States Patent
Kubota

(10) Patent No.: US 7,612,646 B2
(45) Date of Patent: Nov. 3, 2009

(54) FUSE CAVITY STRUCTURE AND ELECTRIC CONNECTION BOX

(75) Inventor: Katsuhiro Kubota, Ogasa-gun (JP)

(73) Assignee: Yazaki Corporation, Tokyo (JP)

( * ) Notice: Subject to any disclaimer, the term of this patent is extended or adjusted under 35 U.S.C. 154(b) by 288 days.

(21) Appl. No.: 10/542,067

(22) PCT Filed: Apr. 2, 2004

(86) PCT No.: PCT/JP2004/004864

§ 371 (c)(1),
(2), (4) Date: Jul. 11, 2005

(87) PCT Pub. No.: WO2004/091062

PCT Pub. Date: Oct. 21, 2004

(65) Prior Publication Data

US 2006/0119463 A1 Jun. 8, 2006

(30) Foreign Application Priority Data

Apr. 4, 2003 (JP) ..... 2003-101286
Apr. 9, 2003 (JP) ..... 2003-105208

(51) Int. Cl.
*H01H 85/02* (2006.01)
*H01H 85/175* (2006.01)

(52) U.S. Cl. ..... 337/186; 337/187; 337/188; 337/189; 337/190; 337/198

(58) Field of Classification Search ..... 337/186–190, 337/198
See application file for complete search history.

(56) References Cited

U.S. PATENT DOCUMENTS 4,432,594 A * 2/1984 Daggett ..... 439/698

(Continued)

FOREIGN PATENT DOCUMENTS

JP 64-89270 A 4/1989

(Continued)

*Primary Examiner*—Anatoly Vortman
(74) *Attorney, Agent, or Firm*—Sughrue Mion, PLLC

(57) ABSTRACT

Fuse cavity structure includes fuses 10, 20 in which each of fusible elements 17, 27 for protecting a circuit from overcurrent is located between terminals 15 or 25, and a housing 59 in which the fuses 10, 20 are mounted; a part of a wall 65 of the housing 59 which partitions the fuse 10, 20 and fuse 10, 20 is removed thereby to form a notch 65H in the wall 65; and space is provided between the fuses 10 or 20. The notch 65H is formed by notching the wall 65 corresponding to at least a part of the fusible portion 17, 27. The fuse 10 has a head portion 13 and jig engagement portions 14*a*. A groove 80 corresponding to the head portion 13 and the jig engagement portions 14*a* is provided within the housing 59. A wide-width portion is provided at the groove 80 in correspondence to the width of the head portion 13 of the fuse 10, and a narrow-width portion is provided at the groove 80 in correspondence to the width of the jig engagement portion 14*a* of the fuse 10 which is narrower than the head portion 13. Another fuse 20 having a different configuration from the fuse 10 is provided at the housing 59 in place of the fuse 10. A positioning portion for making it possible to assemble the another fuse 20 to the housing 59 in a normal state is provided at the groove 80. Such a fuse cavity structure is used for an electric connection box.

2 Claims, 8 Drawing Sheets

U.S. PATENT DOCUMENTS

| | | | | |
|---|---|---|---|---|
| 4,661,807 | A * | 4/1987 | Panaro | 340/638 |
| 4,772,759 | A | 9/1988 | Roy et al. | |
| 5,116,246 | A * | 5/1992 | Perry et al. | 439/620.34 |
| 5,277,626 | A * | 1/1994 | Oikawa et al. | 439/620.27 |
| 5,488,345 | A | 1/1996 | Seki et al. | |
| 6,396,380 | B1 * | 5/2002 | Girke et al. | 337/189 |
| 6,585,541 | B2 * | 7/2003 | Higashida et al. | 439/620.27 |

FOREIGN PATENT DOCUMENTS

| | | | |
|---|---|---|---|
| JP | 4-52351 | U | 5/1992 |
| JP | 7-31486 | Y2 | 7/1995 |
| JP | 8-7961 | A | 1/1996 |
| JP | 8-154327 | A | 6/1996 |
| JP | 9-93757 | A | 4/1997 |
| JP | 2000-3654 | A | 1/2000 |
| JP | 2000-115956 | A | 4/2000 |
| JP | 2000-198395 | A | 7/2000 |
| JP | 2000-208177 | A | 7/2000 |
| JP | 2000-272443 | A | 10/2000 |
| JP | 2000-308236 | A | 11/2000 |
| JP | 2001-325874 | A | 11/2001 |
| JP | 2001-351502 | A | 12/2001 |
| JP | 2002-124175 | A | 4/2002 |
| JP | 2002-313212 | A | 10/2002 |
| JP | 2003-339109 | A | 11/2003 |

* cited by examiner

FUSE CAVITY STRUCTURE AND ELECTRIC CONNECTION BOX

TECHNICAL FIELD

The present invention relates to a fuse cavity structure in which various fuses can be attached, size-reduction is performed, and improvement for heat generation is performed; and to an electric connection box provided with such a fuse cavity structure.

The present invention further relates to a fuse cavity structure with a reduced size and in which various kinds of fuses can be attached and fixed stably and also relates to an electric connection box having such a fuse cavity structure.

BACKGROUND OF THE INVENTION

FIG. 7 shows one embodiment relating to structure of a conventional fuse attachment portion as shown in Unexamined Japanese Patent Publication 2002-124175.

A pair of tab terminals 155 are protruded from an insulation housing 153 in the direction where they are attached into a fuse attachment portion 120, which constitute a first fuse 150. The pair of tab terminals 155 constituting the first fuse 150 are inserted and fitted into a fuse insertion portion 123.

Further, opposite-side terminals 121 are provided into fuse insertion portion 123. The pair of tab terminals 155 are connected to the opposite-side terminals 121. Further, a first stopper 125 is provided for the first fuse insertion portion 123. The first stopper 125 is formed in order to regulate the insertion position of the first fuse 150.

Further, a second fuse 110 is so constituted that a pair of flat-plate terminals 111 are provided respectively on both sides of an insulation housing 113, and that a pitch between the flat-plate terminals 111 has the same dimension as a pitch between the pair of tab terminals 155. The second fuse 110 can be inserted into the fuse insertion portion 123.

Further, a second stopper 126 is provided for the fuse insertion portion 123. The second stopper 126 is formed in order to regulate the insertion position of the second fuse 110 and used in order to connect the flat-plate terminals 111 to the opposite-side terminals 121. The first fuse 150 or the second fuse 110 can be attached into the fuse insertion portion 123.

Further, in other related arts, there is a block heat release structure for electric portions in which heat generated in a housing room can be released to the outside, as shown in Unexamined Japanese Patent Publication 2000-3654.

Further, there is a connection terminal for a heat generating element which has a good heat release performance, and a connection circuit body, which are used when an element such as a PTC element which involves heat generation is connected to a circuit composed of a busbar provided for a wiring plate, as shown in Unexamined Japanese Patent Publication Hei. 8-7961. The PTC means "Positive Temperature Coefficient".

Further, there is an electric connection box which performs heat release of an electric wire for an internal circuit connected to a heat generator, such as a fuse or a relay, as shown in Unexamined Japanese Patent Publication Hei. 8-154327.

Further, there is also a heat release structure of an electric connection box, which has a good heat release effect without causing increase of cost and makes size-reduction possible, as shown in Unexamined Japanese Patent Publication 2000-115956.

Further, there is also an electric connection box which can release, efficiently, heat generated within the electric connection box to the outside of the electric connection box, using a terminal holding spacer as shown in Unexamined Japanese Patent Publication 2003-339109.

Further, there is also an electric connection box which can release, efficiently, heat generated from electrical portions mounted on a print-circuit board to the outside of the electric connection box as shown in Unexamined Japanese Patent Publication 2000-198395.

Further, there is also heat release structure of an electric connection box in which heat generated from an electric connection terminal can be efficiently released to the outside of the electric connection box thereby to prevent increase of temperature in the electric connection box as shown in Unexamined Japanese Patent Publication 2000-208177.

Further, there is also a small-sized power distribution device which is superior in heat release performance as shown in Unexamined Japanese Patent Publication 2000-272443.

Further, there is also an electric connection box which can, without providing a ventilating hole into the electric connection box, and without making the size of the electric connection box large and without changing material, release heat inside the electric connection box to the outside as shown in Unexamined Japanese Patent Publication 2000-308236.

In the conventional fuse attachment portion structure shown in FIG. 7, in case that the fusible element of the fuse 110 is fused at a comparatively low current value, there are no problems. However, if a fuse 110 in which its fusible element is fused at a comparatively high current value is used, when the fusible element of the fuse 110 is fused, there is fear that a thermally bad influence is exerted on the fuse attachment portion 120.

FIG. 8 shows another example of conventional fuse housings as shown in Unexamined Japanese Patent Publication 2002-313212.

A low-height fuse (not shown) is attached to a fuse housing 220. The fuse housing 120 is formed to include left and right side walls 222, 223 and front and rear protection walls 224, 225. A pair of the left and right side walls 222, 223 are arranged to sandwich the narrow-width portions at the left and right sides of a fuse casing made from insulation resin constituting the fuse. The front and rear protection walls 224, 225 are positioned between the left and right side walls 222, 223 and cover the surfaces of the wide-width portions at the front and rear sides of the fuse casing, and each of the front and rear protection walls has a wide width and a low height.

Tabs 206A, 206B at the tip ends of bus bars 205A, 205B protrude from a bottom portion side within a cavity 200S surrounded by the left and right side walls 222, 223 and the front and rear protection walls 224, 225, respectively. The tabs 206A, 206B at the tip ends of the bus bars 205A, 205B are coupled to the input and output terminals of the fuse, respectively. Tab pressing ribs 230 to 233 protrusively provided at the left and right ends of the front and rear protection walls 224, 225 abut against the inner surface side at which a pair of the tabs 205A, 105B are opposed.

As another conventional technique, there is a fuse which can enhance the supporting balance at a fuse attachment portion, miniaturize the fuse attachment portion, improve the workability of an insertion operation and prevent deformation and breakage of a fusible portion due to an external force as shown in Unexamined Japanese Patent Publication 2001-325874.

Further, there is a fuse box which can enhance the supporting balance at a fuse attachment portion, miniaturize the fuse attachment portion and improve the workability of an insertion operation of a fuse as shown in Unexamined Japanese Patent Publication 2001-351502.

Further, there is disclosed the structure of a fuse attachment portion which has compatibility of being arbitrarily capable of attaching fuses of different configurations and is capable of improving the workability of an insertion operation of a fuse as shown in Unexamined Japanese Patent Publication 2002-124175.

As a technique of improving a fuse box to be attached to a vehicle such as an automobile, there is a fuse box which can surely detect that a blade-type fuse is inserted at the rear side in the fuse cavity of the fuse box as shown in Unexamined Japanese Utility Model Publication Hei 4-52351.

However, the conventional fuse housing shown in FIG. 8 is not arranged to stably fix a not-shown low-height fuse in the fuse housing 220, so that it has been desired to improve such a problem.

DETAILED DESCRIPTION OF THE INVENTION

Figure 1:
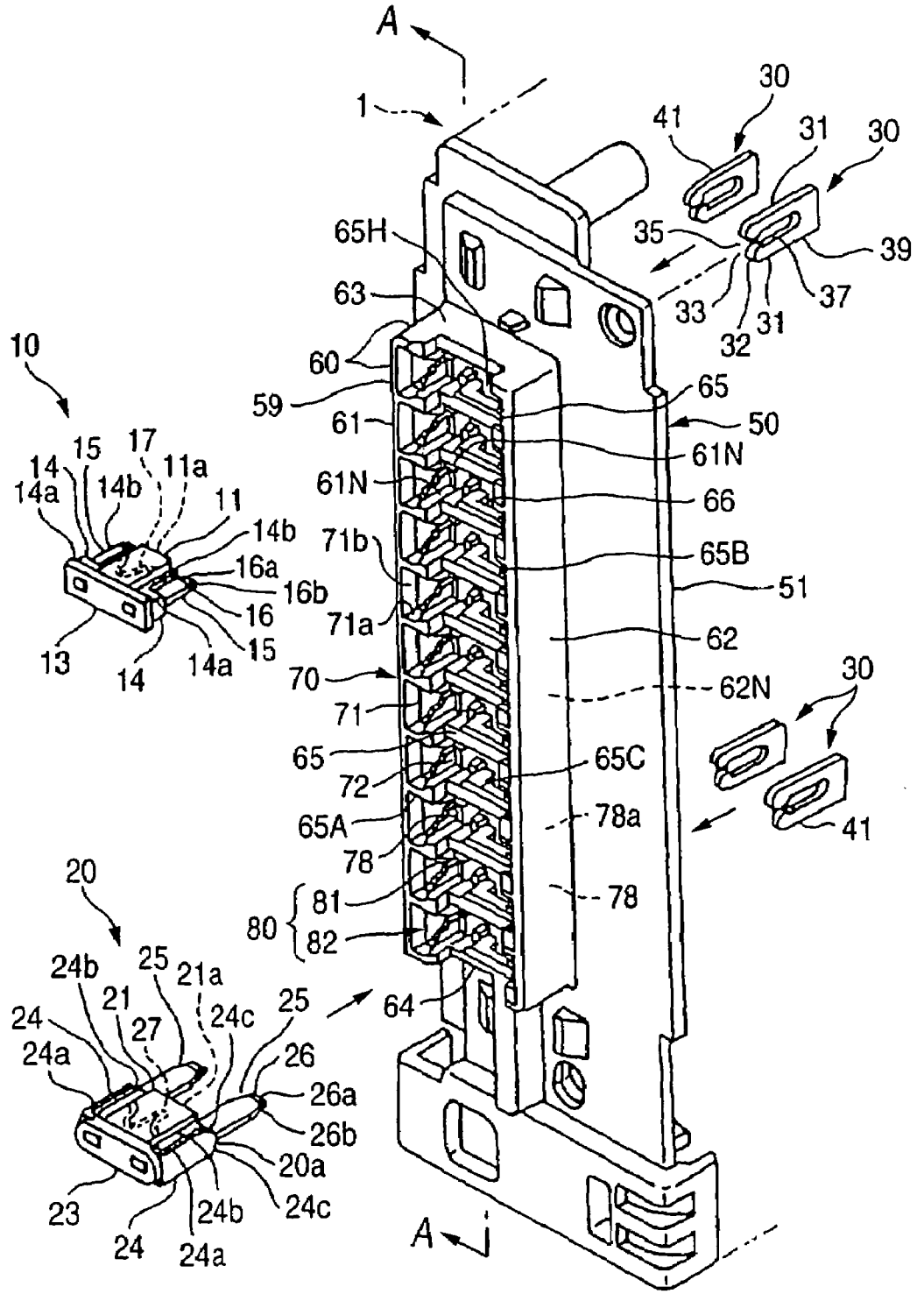
FIG. 1 is an exploded perspective view showing one embodiment of fuse cavity structure and a electric connection box according to the first embodiment of the present invention.

In view of the above problem, it is an object of the invention to provide a fuse cavity structure with improved heat generation even in a case where a fuse having its fusible element fused at a comparatively high current value is used, and an electric connection box provided with such a fuse cavity structure.

Another object of the invention is to provide a fuse cavity structure which can fix a fuse stably and an electric connection box having such a fuse cavity structure.

In order to achieve the above object, a fuse cavity structure according to the first aspect of the invention includes a fuse in which a fusible element for protecting a circuit from over current is located between terminals, and a housing in which the fuse is mounted, is provided with a partition wall which partitions the fuse and contains a notch.

Hereby, the heat generated from the fusible element of the fuse is not blocked by the wall, but is released through air. Therefore, occurrence of such a disadvantage that heat generation from the fuse exerts a bad influence on the housing is prevented.

The fuse cavity structure according to the second aspect of the invention is provided in that the notch is formed by notching the wall corresponding to at least a part of the fusible element.

Hereby, when overcurrent is applied between terminals of the fuse, and the fusible element located between the terminals is fused, the heat generated from the fusible element is directly released to an air layer, so that a heat release effect of the housing is improved.

An electric connection box according to the third aspect of the invention is provided in that the fuse cavity structure according to the first or second aspect is used.

Hereby, a electric connection box having a good heat release effect is provided.

In order to attain the aforesaid object, a fuse cavity structure according to a fourth aspect of the present invention is provided by including a fuse and a housing to which the fuse is assembled, wherein the fuse has a head portion and a jig engagement portion, and a groove corresponding to the head portion and the jig engagement portion is provided within the housing.

According to such a configuration, since the groove corresponding to the head portion of a fuse and the jig engagement portion is provided within the housing, the fuse can be stably assembled to the housing. Further, when a low-height fuse is employed, the head portion of the fuse is housed within the groove of the housing and so the head portion of the fuse is housed within the housing. Thus, a miniaturized fuse cavity structure can be provided.

A fuse cavity structure according to a fifth aspect of the present invention is provided in that, in the fuse cavity structure according to the first aspect of the present invention, a wide-width portion is provided at the groove in correspondence to a width of the head portion of the fuse, and a narrow-width portion is provided at the groove in correspondence to a width of the jig engagement portion of the fuse which is narrower than the head portion.

According to such a configuration, the fuse can be surely attached to the grooves provided within the housing. Further, the width of the jig engagement portion is made narrower than the width of the head potion of the fuse. Thus, when the fuse attached to the grooves is pulled out by means of a jig such as a fuse puller, for example, the jig is likely engaged at its tip end portion with the head portion and the jig engagement portion constituting the fuse.

A fuse cavity structure according to a sixth aspect of the present invention is provided in that, in the fuse cavity structure according to the fourth or fifth aspect of the present invention, another fuse having a different configuration is provided at the housing, and a positioning portion for enabling the other fuse to be assembled to the housing in a normal state is provided at the groove.

According to such a configuration, at least two kinds of fuses can be attached to the housing. For example, in recent years, it has been demanded to make it possible to attach various kinds of fuses to the housing, and to reduce a management cost by commonly using the parts thereby to reduce the cost of the parts. In this respect, when a plurality of the fuses, having different configurations, are arranged to be able to be attached to the housing, the parts can be commonly used and hence the cost of the parts can be reduced.

A fuse cavity structure according to a seventh aspect of the present invention is provided in that, in the fuse cavity structure according to the sixth aspect of the present invention, the positioning portion is formed as a tapered surface, and a slanted surface is provided at a side portion of the other fuse in correspondence to the tapered surface.

According to such a configuration, when the other fuse is assembled to the housing, the slanted surface provided at the side portion of the other fuse is aligned to the tapered surface of the groove of the housing, so that the other fuse can be surely fixed to the housing. Further, the fuse having the different configuration from the other fuse can be surely fixed to the groove of the housing without being influenced by the tapered surface of the groove of the housing.

A fuse cavity structure according to the eighth aspect of the present invention is provided in that the fuse cavity structure according to one of the fourth to eight aspect of the present invention is employed.

According to such a configuration, it is possible to provide the electric connection box to which a fuse can be stably assembled. Further, when the fuse cavity structure according to the third or fourth aspect of the present invention is applied to the electric connection box, it is possible to provide the electric connection box to which at least two kinds of the fuses with different configurations can be assembled.

BEST MODE FOR CARRYING OUT THE INVENTION

First Embodiment

First embodiment of fuse cavity structure and an electric connection box according to the invention will be described below with reference to drawings in detail.

Figure 2:
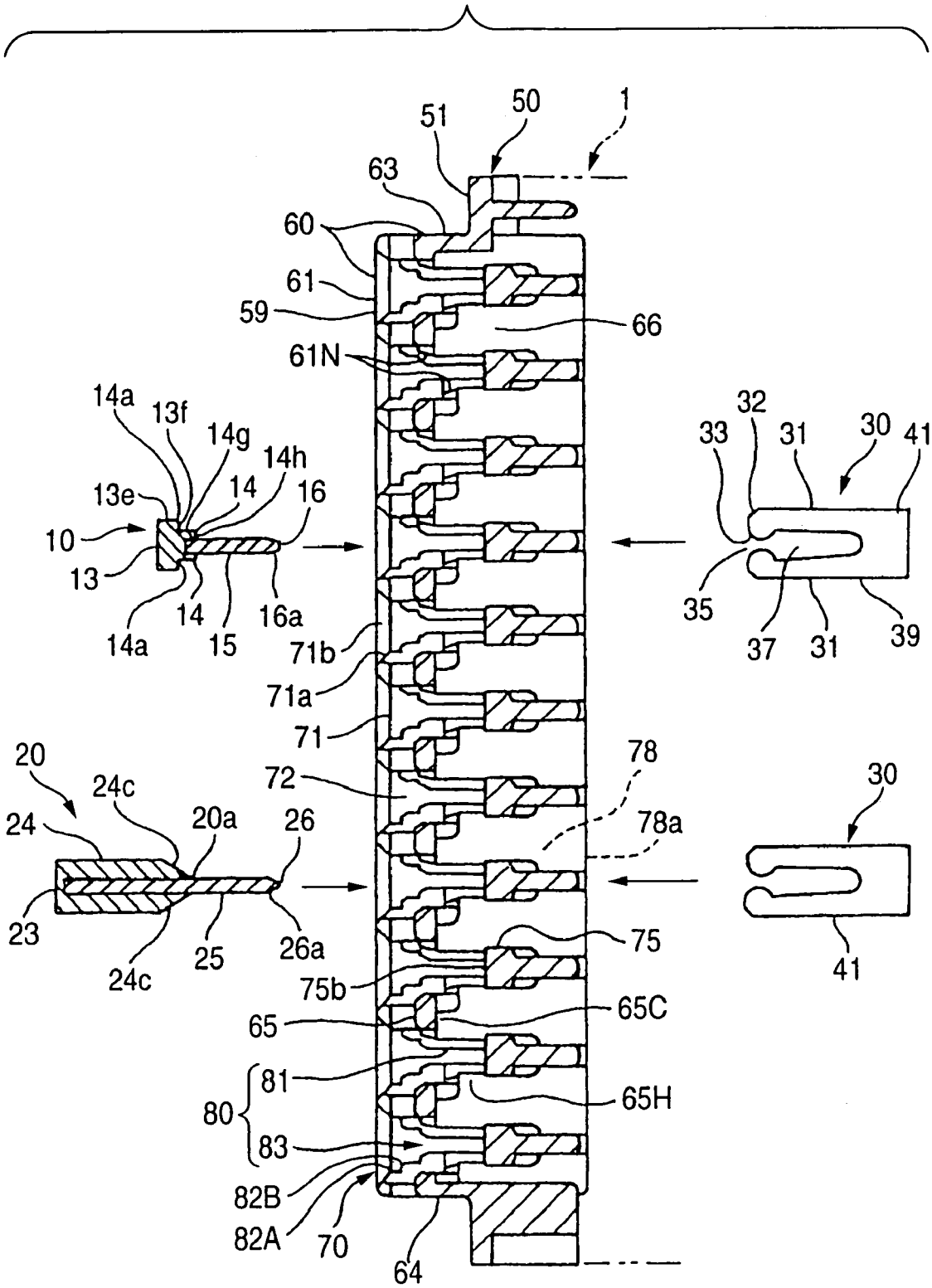
FIG. 2 is a longitudinal sectional view showing the fuse cavity structure and the electric connection box according to the first embodiment of the present invention.
Figure 3:
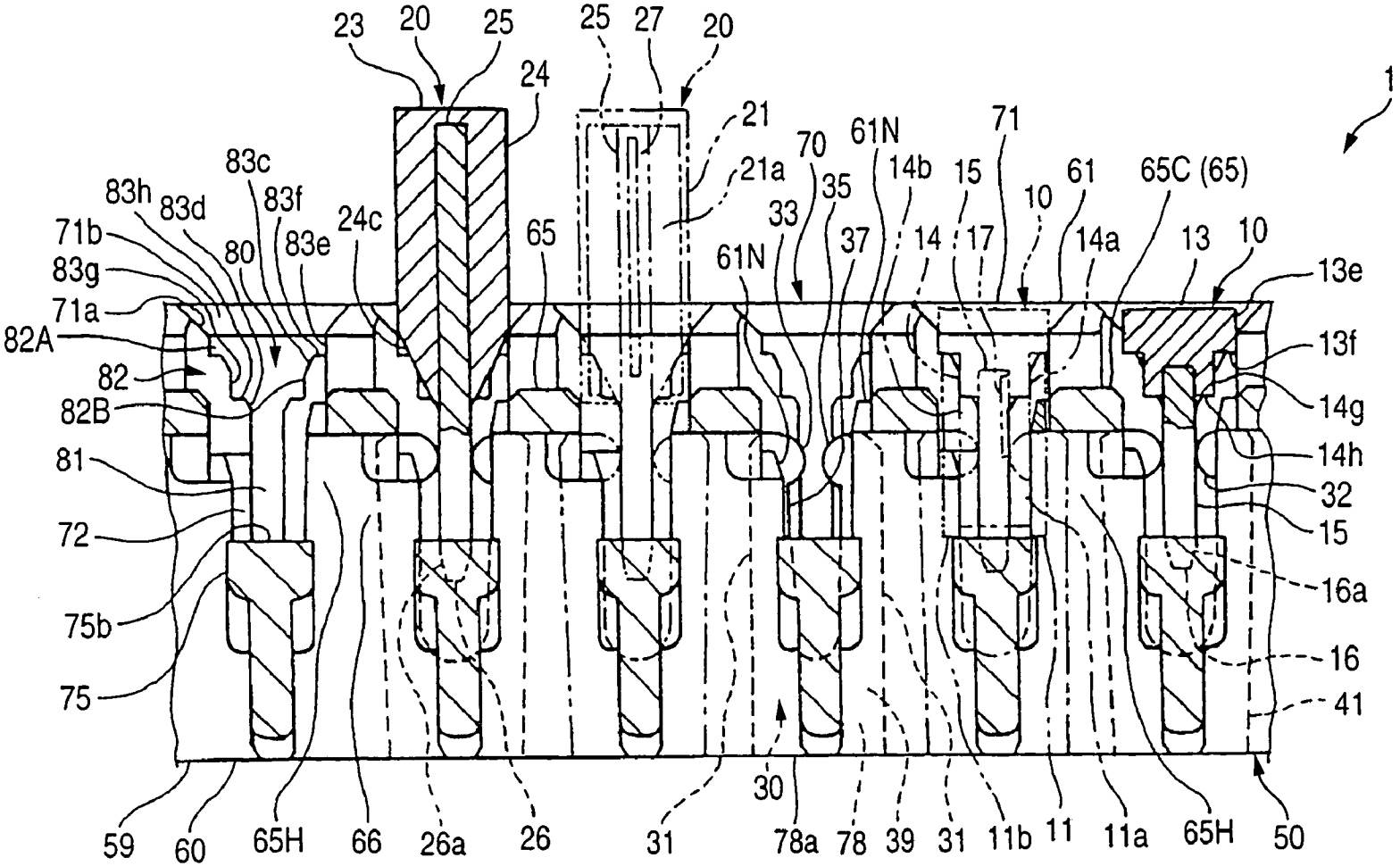
FIG. 3 is an explanatory view showing the fuse cavity structure and the electric connection box according to the first embodiment of the present invention.
Figure 4:
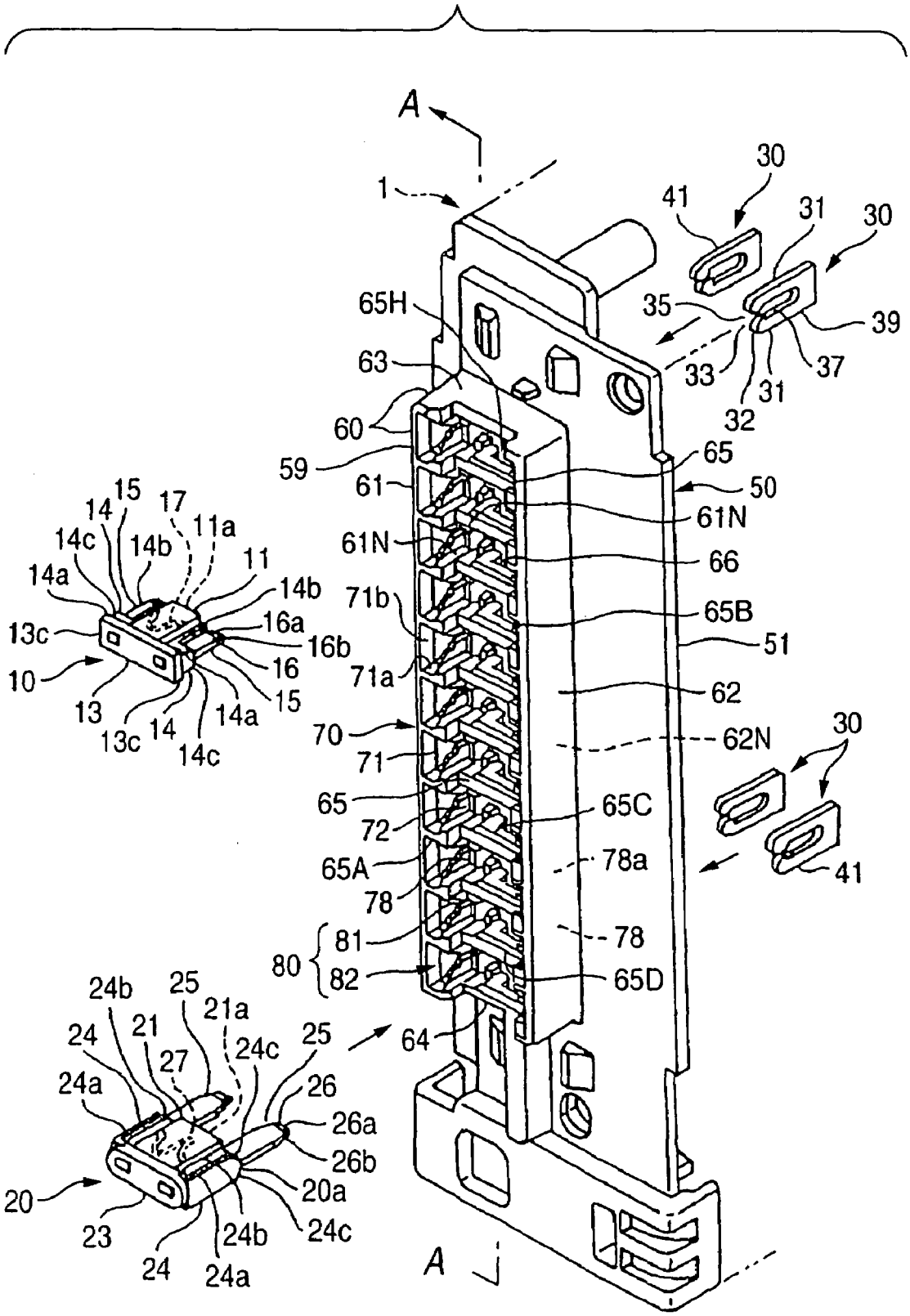
FIG. 4 is an exploded perspective view showing the embodiment of the fuse cavity structure and the electric connection box according to a second embodiment of the present invention.

FIG. 1 is an exploded perspective view showing a first embodiment of fuse cavity structure and the electric connection box according to the invention, FIG. 2 is a longitudinal sectional view showing the fuse cavity structure and the electric connection box, and FIG. 3 is an explanatory view showing the fuse cavity structure and the electric connection box.

Each section of a main portion in each figure is shown as a schematic diagram, which is partially simplified so that the main portion is easily understood and easily seen. Further, regarding a first fuse 10 and a second fuse 20, overlapping portions are explained together as a matter of convenience.

In a fuse attachment portion 70 in a housing 59 of a block body 50, two kinds of fuses, the first fuse 10 and the second fuse 20 can be attached. The first fuse 10 is different from the second fuse 20 in regard to, for example, current rating, shape or the like. Further, as fuses attachable to the bock body 50, there are, for example, various blade-type fuses which can correspond to 5 A to 30 A.

The first fuse 10 comprises at least an insulation housing 11, a pair of flat-plate terminals 15 which are protruded along side edge portions 14*b* of a pair of narrow protrusions 14 in this insulation housing 11 from the protrusions 14, and a nearly U-shaped fusible portion 17 which electrically connects one flat-plate terminal 15 and the other flat-plate terminal 15 in the insulation housing 11. The nearly U-shaped fusible portion 17 is located into a housing portion 11*a* of the insulation housing 11. Further, from a head portion 13 and the insulation housing 11, the protrusion 14 that is narrower than the head portion 13 and the insulation housing 11 extends.

Further, a stepped jig fitting portion 14*a* which corresponds to the leading end of a jig (not shown) such as a fuse puller is provided in the insulation housing 11 of the first fuse 10, so that the first fuse 10 attached to the fuse attachment portion 70 can be readily pulled out from the fuse attachment portion 70. The jig fitting portion 14*a* is formed so as to include at least the head portion 13 and the protrusion 14. Further, the first fuse 10 is referred to also as a short fuse or a small-sized fuse 10.

Since the first fuse 10 is the small-sized fuse that is shorter than the second fuse 20, once the first fuse 10 is attached into the block body 50 as shown in FIG. 3, it is not easy to pull out the first fuse 10 from the block body 50 by a hand. The first fuse 10 or the second fuse 20 is pulled out from the block body 50 by use of the jig such as the fuse puller (not shown).

The second fuse 20 comprises at least an insulation housing 21, a pair of tab terminals 25 which are protruded from the inside of this insulation housing 21 toward the outside of the insulation housing 21, and a nearly U-shaped fusible element 27 which connects electrically one tab terminal 25 and the other tab terminal 25 in the insulation housing 21. The nearly U-shaped fusible element 27 is located into a housing portion 21*a* of the insulation housing 21. Further, on both sides of the insulation housing 21, plate-like side portions 24 are provided thereby to form a groove 24*b* between the insulation housing 21 and the side portion 24. Along the groove 24*b*, the tab terminal 25 is extended from an end 20*a* of the groove 24*b*.

Further, a stepped jig fitting portion 24*a* which corresponds to the leading end of a jig (not shown) such as a fuse puller is provided in the insulation housing 21 of the second fuse 20, so that the second fuse 20 attached to the fuse attachment portion 70 can be readily pulled out from the fuse attachment portion 70. The jig fitting portion 24*a* is formed so as to include at least a head portion 23, the side portion 24 and the groove 24*b* provided between the head portion 23 and the side portion 24. Further, the fuse 20 is referred to, for example, as a mini-fuse 20.

Regarding the fusible elements 17, 27 constituting the fuses 10, 20, provided in the housing portions 11*a*, 21*a* of the insulation housings 11, 21, in order to quickly judge whether the fusible elements 17, 27 are in an electrically connected state or whether the fusible elements 17, 27 are fused and are not in the electrically connected state, the insulation housings 11, 21 are formed of transparent or semitransparent synthetic resin material.

Further, in order to readily determine an electric current value to which each fuse 10, 20 corresponds and to prevent erroneous attachment of each fuse 10, 20, a colorant, for example, a yellow colorant or a red colorant, is added to the synthetic resin materials of the insulation housings 11, 21, such that they can be distinguished from each other.

The flat-plate terminal 15 provided for the first fuse 10 and the tab terminal 25 provided for the second fuse 20 are formed into blade-like terminals 15, 25. Further, for leading ends 16, 26 of the terminals 15, 25, wide inclined surfaces 16*a*, 26*a* and narrow inclined surfaces 16*a*, 26*a* are provided. The wide inclined surfaces 16*a*, 26*a* are provided in order to forcefully widen each fee end 32 of a U shaped terminal 30 by the leading end 16, 26 of each terminal 15, 25 when each terminal 15, 25 is inserted and attached to the U shaped terminal 30.

Each U shaped terminal 30 comprises a pair of movable arms 31 which can hold the blade terminal 15, 25 provided for the fuse 10, 20 therebetween; curve-like holding portions 33 which are provided inside leading ends 32 of the pair of movable arms 31 and put the blade terminal 15, 25 therebetween when they are electrically connected to the blade terminal 15, 25; an insertion-hold space 35 which is provided between the leading ends 32 of the pair of movable arms 31, into which the blade terminal 15, 25 is inserted and by which the blade terminal 15, 25 is held; a nearly U-shaped housing space 37 into which the blade terminal 15, 25 is located; and a base portion 39 to which the pair of movable arms 31 are extended. These portions function-as an electric contact portion 41 forming a busbar (not shown).

As the busbar, there is, for example, a busbar in which plural electric contact portions 41 are arranged in one busbar body (not shown), or a busbar in which an electric contact portion 41 is provided at only one end of one busbar body (not shown).

Each leading end 32 of the pair of movable arms 31 functions as a free end 32 which can open and close when the movable arms 31 hold the blade terminal 15, 25 provided for the fuse 10, 20 between. Further, since the U shaped terminal 30 holds surely the blade terminal 15, 25 of each fuse 10, 20, and connects to the blade terminal 15, 25 electrically, it is referred to also as a hold terminal 30.

Each terminal 15, 25, 30 is formed by stamping and pressing a flat plate-like metal material. If a surface treatment such as tinning is provided to the terminal 30, corrosion resistance of the terminal 30 is improved. Therefore, even if the terminal 30 is heated at a high temperature by heat generated when each fuse 10, 20 is fused, the corrosion of the terminal 30 is prevented.

The block body 50 to which each fuse 10, 20 and the U shaped terminal 30 are attached includes at least a flat plate-like base portion 51, and the plural fuse attachment portions 70 constituting the housing 59 provided on the base portion 51. The plural fuse attachment portions 70 are formed by a rectangular box-shaped peripheral wall 60 forming the housing 59, and partition walls 65 which partition this peripheral wall 60 into plural parts at a nearly equal interval.

Further, by each side wall 61, 62, 63, 64 constituting the peripheral wall 60, and the partition walls 65, a housing portion 72 to which the first fuse 10 or the second fuse 20 can be attached is provided in the fuse attachment portion 70. Further, for the housing portion 72, an opening portion 71 is provided, into which the first fuse 10 or the second fuse 20 can be inserted. The fuse attachment portion 70 including the housing portion 72 is referred to also as a connector cavity.

The peripheral wall 60 comprises a pair of side walls 61, 62 formed in the longitudinal direction of the block body 50, and a pair of side walls 63, 64 that are shorter than the side walls 61, 62 and orthogonal to the side walls 61, 62.

For each opening portion 71 of the fuse attachment portion 70 constituted by each sidewall 61, 62, 63, 64 and each partition wall 65, inclined guide surfaces 71*a*, 71*b* are provided. These inclined guide surfaces 71*a*, 71*b* are provided in order to readily attach the first fuse 10 or the second fuse 20 into the fuse attachment portion 70 of the housing 59.

Further, when the first fuse 10 is inserted and attached into the fuse attachment portion 70, the insulation housing 11 of the first fuse 10 is guided and inserted into the fuse attachment portion 70 by a coupling portion 65C of the partition wall 65 of the fuse attachment portion 70 and inner walls 61N, 62N of the fuse attachment portion 70.

A stop portion 75 is provided, which stops further insertion of the first fuse 10 into the fuse attachment portion 70, and positions the first fuse 10 in the fuse attachment portion 70.

Further, inside of the pair of sidewalls 61, 62 formed in the longitudinal direction of the block body 50, the inner walls 61N, 62N are formed along the pair of sidewalls 61, 62 in parallel. Further, between one sidewall 61 and the other sidewall 62, the partition wall 65 that is orthogonal to the inner walls 61N, 62N is provided.

A housing portion 78 into which the U shaped terminal 30 is inserted and attached is formed by the pair of side walls 61, 62 formed in the longitudinal direction of the block body 50, the inner walls 61N, 62N formed along the pair of side walls 61, 62 in parallel, and one end 65A and the other end 65B of the partition wall 65 connecting the side walls 61 and 62, and connecting the inner walls 61N and 62N. As shown in FIG. 2, from an insertion port 78*a* on the opposite side of the opening portion 71, the U shaped terminal 30 is inserted and attached into the housing portion 78 (FIG. 3).

Further, inside of the pair of side walls 61, 62 formed in the longitudinal direction of the block body 50, grooves 80 corresponding to both the first fuse 10 and the second fuse 20 are provided. This groove 80 comprises a right vertical portion 81 and a stepped portion 82. As shown in FIGS. 2 and 3, the stepped portion 82 of the groove 80 comprises a wide portion 82A corresponding to the head portion 13 of the first fuse 10, and a narrow portion 82B corresponding to the protrusion 14 of the first fuse 10.

Corresponding to a side surface 13*e* of the head portion 13 of the first fuse 10, a side surface 83*e* is provided for the wide portion 82A of the stepped portion 82 of the groove 80; and corresponding to an end surface 13*f* of the head portion 13 of the first fuse 10, an end surface 83*f* is provided for the wide portion 82A of the stepped portion 82 of the groove 80. Further, corresponding to a side surface 14*g* of the protrusion 14 of the first fuse 10, a side surface 83*g* is provided for the narrow portion 82B of the stepped portion 82 of the groove 80; and corresponding to an end surface 14*h* of the protrusion 14 of the first fuse 10, an end surface 83*h* is provided for the narrow portion 82B of the stepped portion 82 of the groove 80. Also, corresponding to an inclined surface 24*c* of the side portion 24 of the second fuse 20, inclined surfaces 83*c*, 83*d* are provided for the narrow portion 82B of the stepped portion 82 of the groove 80.

When the first fuse 10 is attached into the fuse attachment portion 70 of the housing 59, one end surface 11*b* (FIG. 3) of the insulation housing 11 of the first fuse 10 is brought into contact with a stop surface 75*b* of a stop portion 75 of the fuse attachment portion 70, whereby insertion of the first fuse 10 into the fuse attachment portion 70 is stopped.

Further, when the second fuse 20 is attached into the fuse attachment portion 70 of the housing 59, the inclined surface 24*c* (FIGS. 1 and 2) of the side portion 24 of the second fuse 20 is brought into contact with inclined surfaces 83*c*, 83*d* (FIG. 3) of the stepped portion 82 of the fuse attachment portion 70, whereby insertion of the second fuse 20 into the fuse attachment portion 70 is stopped.

Thermoplastic synthetic resin, which is superior in formability, is used as a material of the block body 50. The block body 50 is formed using an injection mold method which is superior for mass productivity. Further, the block body is referred to as a fuse block or a fuse plate.

As shown in FIG. 1, the fuse cavity structure according to one embodiment of the invention comprises at least the fuses 10, 20 in which each of the fusible elements 17, 27 for protecting the circuit from overcurrent is located between the pair of terminals 15 or 25, and the housing 59 in which the plural fuses 10, 20 are mounted.

In order to partition the fuse 10 or 20 attached to the block body 50, the partition wall 65 is provided in the housing 59 of the block body 50. Further, a part of the partition wall 65 of the housing is removed thereby to provide the notch 65H for the partition wall 65. The notch 65H of the partition wall 65 serves as a through-hole that communicates with the housing portion 72 of the adjacent fuse attachment portion 70. The notches 65H may be provided for the short sidewalls 63, 64 of the housing 59.

Further, when each first fuse 10 is attached into the housing 59 of the block body 50, a space 66 (FIG. 3) is provided, in the housing 59 of the block body 50, between the insulation housings 11 of the first fuse 10.

When the fuse cavity structure is used in the electric connection box 1, and the fusible portion 17 of the first fuse 10 is fused due to overcurrent, the heat generated from the fusible portion 17 of the first fuse 10 is not blocked by the partition walls 65 in the housing 59, but is released through the air in the space 66. Accordingly, the disadvantage of high temperature heat generated from the first fuse 10 exerting a bad influence on the partition walls 65 of the housing 59 is prevented.

As shown in FIG. 1, the partition wall 65 has the through hole-shaped notch portion 65H and the coupling portion 65C for connecting the inner walls 61N and 62N located on the both sides of this partition wall 65. If maintenance of the electric connection box 1 is performed in a fuse heat release structure in which no partition walls (65) are provided in a housing (59), metal such as a tool (not shown) would touch a U shaped terminal (30) in the housing (59) carelessly, such that a short circuit could occur. However, since the coupling portion 65C of the partition wall 65 for partitioning the fuse attachment portion 70 is provided, the occurrence of a disadvantage such as a short circuit is readily avoided.

The notch 65H of the partition wall 65 is formed by cutting off the partition wall 65 corresponding to a part of the fusible portion 17 (FIG. 3) of the first fuse 10. The partition wall 65 facing a part of the fusible portion 17 of the first fuse 10 is cut off. In case of such a fuse cavity structure, when the overcurrent is applied between the terminals 15 of the first fuse 10 and the fusible portion 17 between the terminals 15 is fused, the heat of the fusible portion 17 is directly released to an air layer, so that the heat release effect of the housing 59 is improved. Therefore, heat damage of the housing 59 of the block body 50 formed of thermoplastic synthetic resin is avoided.

Further, as shown in FIG. 3, in case of the fuse cavity structure in which a slight gap is provided between the insulation housing 11 of the first fuse 10 and the coupling portion 65C of the partition wall 65 in the state where the first fuse 10 is inserted and attached into the housing 59 of the block body 50, and the insulation housing 11 does not come into contact with the coupling portion 65C, the heat generated when the fusible portion 17 in the housing portion 11*a* of the insulation housing 11 is fused is not directly transmitted to the coupling portion 65C of the partition wall 65. Therefore, the partition wall 65 is not affected by the heat.

As the first fuse 10, even in case that a fuse corresponding to a comparatively high current value, for example, 10 A or more, or a fuse 10 for large current of 20 A or more is used, exposure of the partition wall 65 of the housing 59 of the block body 50 to a high temperature is avoided.

Even in case that the short fuses 10 for large current are arranged densely in the housing 59 of the block body 50, the disadvantage due to the heat is not produced, so that the block body 50 of a miniature and compact size can be used.

Since the mounting structure of the above small-sized fuse 10 copes with the heat generated from the fuse 10, the block body 50 made of thermoplastic synthetic resin can be used for a long time without deforming. Further, by applying the above fuse cavity structure to the electric connection box 1, it is possible to provide the electric connection box 1 that is superior in heat release effect.

Second Embodiment

The second embodiment of a fuse cavity structure and an electric connection box according to the invention will be explained in detail with reference to the accompanying drawings.

Figure 5:
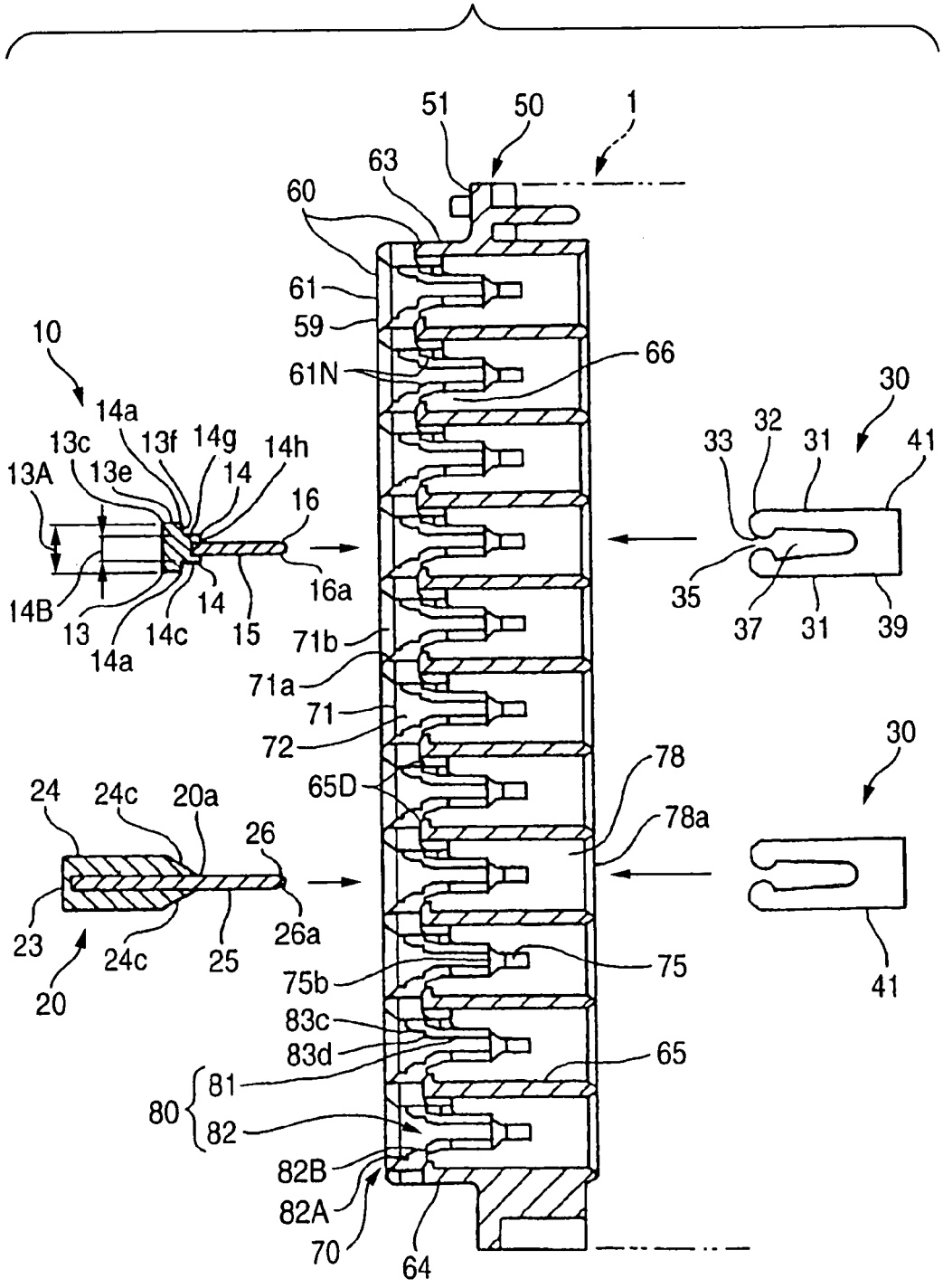
FIG. 5 is a longitudinal sectional diagram showing the fuse cavity structure and the electric connection box according to the second embodiment of the present invention.
Figure 6:
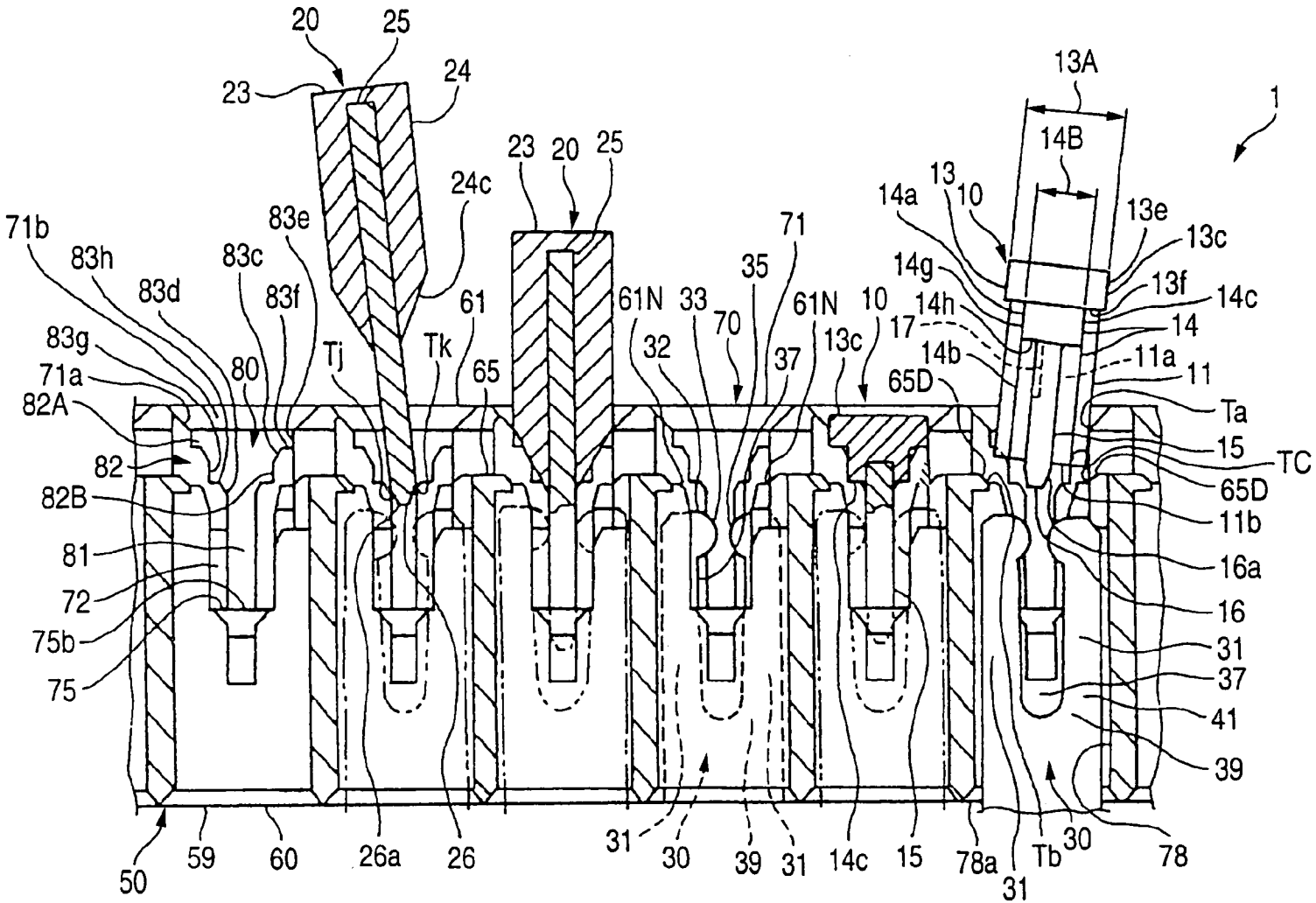
FIG. 6 is an explanatory diagram showing the fuse cavity structure and the electric connection box according to the second embodiment of the present invention.
Figure 7:
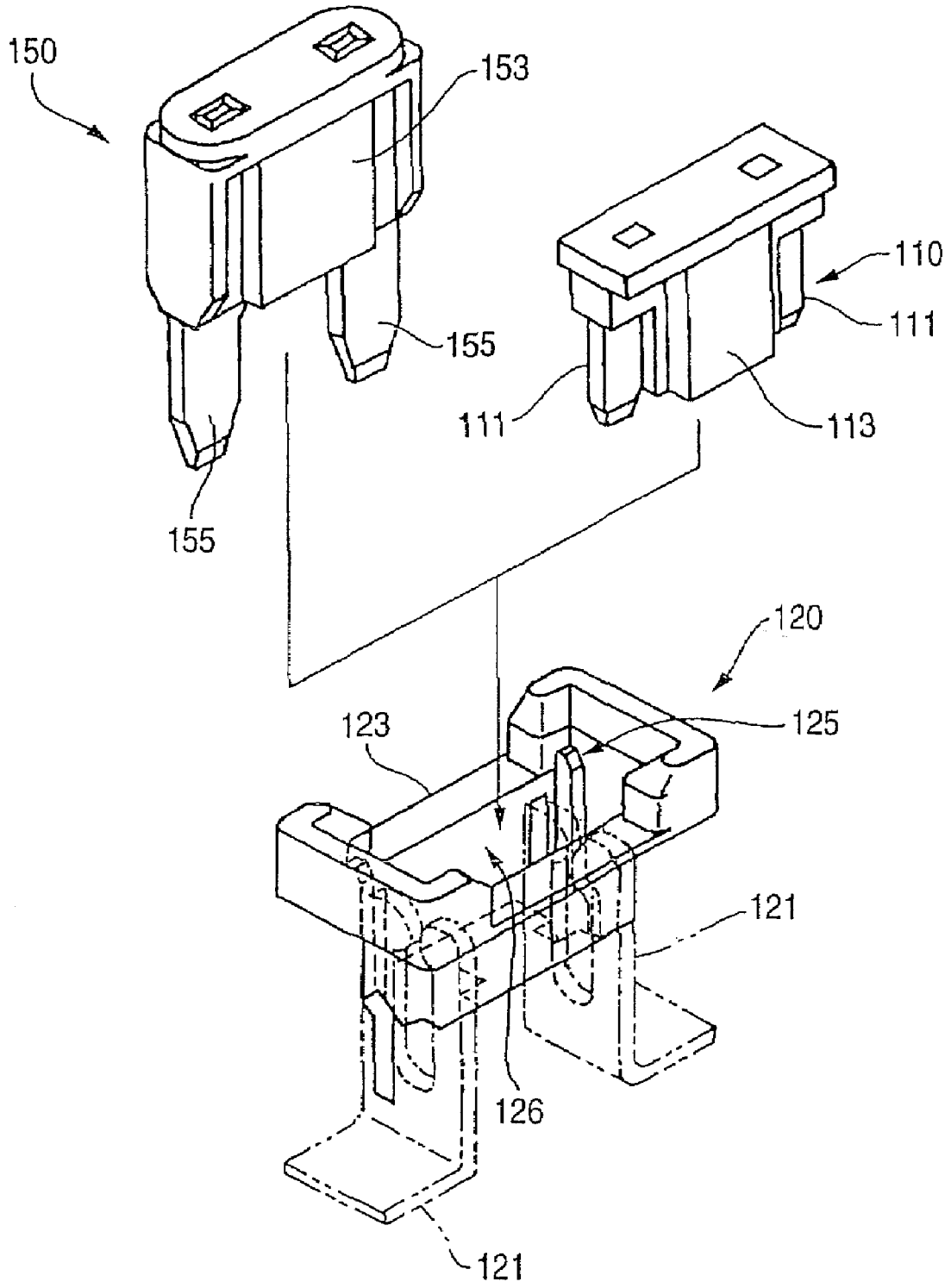
FIG. 7 PRIOR ART
FIG. 7 is an exploded perspective view showing one embodiment of structure of a conventional fuse attachment portion.
Figure 8:
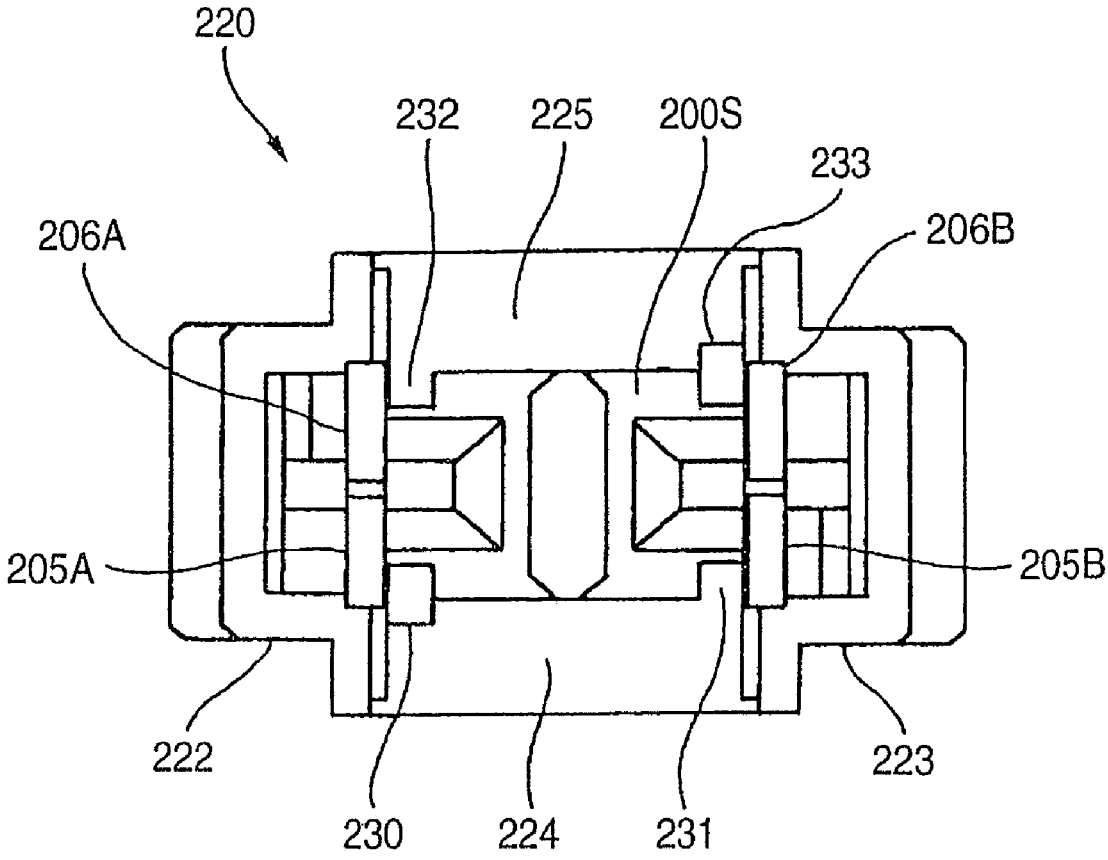
FIG. 8 PRIOR ART
FIG. 8 is a plan view showing another example of conventional fuse housings.

FIG. 5 is an exploded perspective view showing the embodiment of the fuse cavity structure and the electric connection box according to the invention, FIG. 6 is a longitudinal sectional diagram showing the fuse cavity structure and the electric connection box according to the embodiment, and FIG. 7 is an explanatory diagram showing the fuse cavity structure and the electric connection box according to the embodiment.

In order to make easily understand the main portion of each of the drawings, each of the sectional portions is partly abbreviated thereby to be shown as a schematic diagram which can be seen easily. The same portions of a first fuse 10, a second fuse 20 and the first embodiment of the present invention are explained together for the sake of convenience.

As shown in FIGS. 5 to 7, the embodiment of the fuse cavity structure according to the invention is configured to include the low-height blade-shaped fuses 10 and the block main body 50 having the housing 59 in which the low-height blade-shaped fuses 10 are assembled. The low-height fuse 10 is assembled to each of the fuse attachment portions 70 of the housing 59 constituting the block main body 50. Each of the fuse attachment portions 70 of the housing 59 constituting the block main body 50 is also arranged to be able to assemble therein each of the high-height other fuses 20.

Further, an inclined guide surface 65D is provided at the opening portion 71 side of the partition wall 65. The inclined guide surface 65D is provided so that the first fuse 10 or the second fuse 20 can be easily attached to the fuse attachment portion 70 of the housing 59.

The wide portion 82A of the stepped portion 82 of the groove 80 is provided on the opening portion 71 side of the fuse attachment portion 70 of the housing 59. Further, the narrow portion 82B of the stepped portion 82 of the groove 80 is provided on the housing portion 72 side, which is the inner side of the fuse attachment portion 70 of the housing 59. Further, the straight portion 81, having a width which is narrower than the narrow portion 82B of the stepped groove 80, is provided to extend from the narrow portion 82B of the stepped portion 82 to the insertion port 78*a* for the U-shaped terminal 30. The straight portion 81 of the groove 80 is provided in correspondence to the terminals 15, 25 of the fuses 10, 20.

The low-height fuse 10 includes the head portion 13 and a pair of the jig engagement portions 14*a*. The groove 80 having the stepped portion 82 is provided at the inside of each of the both side walls 61, 62 within the housing 59 in correspondence with the head portion 13 and the jig engagement portion 14*a* of the low-height fuse 10. The both end portions 13*c* of the head portion 13 and the both end portions 14*c* of the jig engagement portion 14*a* of the low-height fuse 10 engage with the stepped portion 82 of the groove 80 as shown in FIG. 7.

When the low-height fuse 10 is attached to the fuse attachment portion 70 of the housing 59, the one end surface lib shown in FIG. 7 of the insulation housing 11 of the low-height fuse 10 abuts against the stop surface 75*b* of the stop portion 75 of the fuse attachment portion 70, whereby the insertion operation of the fuse 10 into the fuse attachment portion 70 is stopped.

The groove 80 provided with the stepped portion 82 is provided at the inside of each of the both side walls 61, 62 of the housing 59 in correspondence with the head portion 13 and the jig engagement portion 14*a* of the low-height fuse 10, so that the low-height fuse 10 can be stably assembled to the fuse attachment portion 70 of the housing 59.

Further, when the low-height fuse 10 is assembled to the fuse attachment portion 70 of the housing 59, the both end portions 13*c* of the head portion 13 and the both end portions 14*c* of the jig engagement portion 14*a* of the low-height fuse 10 are completely housed within the step portions 82 of the groove 80 of the housing 59 shown in FIG. 7. The head portion 13 of the low-height fuse 10 assembled to the housing 59 is completely housed within the housing 59.

When the high-height other fuse 20 is assembled to the fuse attachment portion 70 of the housing 59, the head portion 23 of the other fuse 20 protrudes from the opening portion 71 of the fuse attachment portion 70 of the housing 59. In contrast, in the low-height fuse 10 housed within the housing 59, the head portion 13 of the fuse 10 does not protrude from the opening portion 71 of the fuse attachment portion 70 of the housing 59 but is completely housed within the peripheral wall 60 of the housing 59. The low-height fuse 10 is completely inserted into the housing portion 72 of the fuse attachment portion 70.

In this manner, when the low-height fuse 10 is assembled to the fuse attachment portion 70 of the housing 59, the miniaturized fuse cavity structure is configured. Thus, the miniaturized fuse cavity structure can be provided.

As shown in FIGS. 6 and 7, the wide portion 82A is provided at the stepped portion 82 of the groove 80 in correspondence to the width 13A of the potion 13 of the low-height fuse 10. Further, the narrow portion 82B is provided at the stepped portion 82 of the groove 80 in correspondence to the width 14B of the jig engagement portion 14*a* which width is narrower than the width of the head potion 13 of the low-height fuse 10. The direction of the "width" in this specification means an arrangement direction of the fuses when a plurality of the fuses 10 or 20 shown in FIGS. 5 to 7 are attached to the fuse attachment portion 70 of the housing 59.

When the groove 80 having such a step-like configuration is provided at the insides of both the side walls 61, 62 of the housing 59, the low-height fuse 10 can be surely attached to the groove 80 provided within the housing 59. Further, the width 14B of the jig engagement portion 14*a* is made narrower than the width 13A of the head potion 13 of the low-height fuse 10. Thus, when the low-height fuse 10 attached to the groove 80 is pulled out by means of a jig (not shown) such as a fuse puller, for example, the fuse puller is likely engaged at its tip end portion with the head portion 13 and the jig engagement portion 14*a* constituting the low-height fuse 10.

Therefore, even when the low-height fuse 10 is completely housed within the peripheral wall 60 of the housing 59 without protruding the head portion 13 of the low-height fuse 10 from the opening portion 71 of the fuse attachment portion 70 of the housing 59, the low-height fuse 10 attached within the housing portion 72 of the housing 59 can be easily pulled out from the housing 59 by using a jig such as a fuse puller (not shown).

The other fuse 20 having the different configuration from the low-height fuse 10 can be attached to the fuse attachment portion 70 of the housing 59 in place of the low-height fuse 10. In order to surely assemble the high-height other fuse 20 also to the fuse attachment portion 70 of the housing 59, positioning portions 83*c*, 83*d* are provided at the stepped portion 82 of each of the grooves 80 of the housing 59 so that the high-height other fuse 20 can be assembled to the housing 59 in a normal posture, as shown in FIGS. 6 and 7.

When such the positioning portions 83*c*, 83*d* are provided at the stepped portion 82 of each of the grooves 80 of the housing 59, at least two kinds of fuses 10, 20, that is, at least the low-height fuse 10 and the high-height other fuse 20 can be attached to the fuse attachment portion 70 of the single housing 59. For example, in recent years, it has been demanded to make it possible to attach the fuses 10, 20 with various capacities to the housing 59, and to reduce a management cost by commonly using the parts thereby to reduce the cost of the parts. In this respect, when a plurality of the fuses 10, 20 with the different configurations are arranged to be able to be attached to the single housing 59, the parts can be commonly used and hence the cost of the parts can be reduced.

The positioning portions 83*c*, 83*d* provided at the stepped portion 82 of the groove 80 of the housing 59 are formed as tapered surfaces 83*c*, 83*d* shown in FIG. 7, respectively. The first tapered surface 83*c* constituting the positioning portions 83*c*, 83*d* is configured as a slanted surface coupling the end surface 83*f* of the wide portion 82A of the stepped groove 80 and the side surface 83*g* of the narrow portion 82B. Further, the second tapered surface 83*d* constituting the positioning portions 83*c*, 83*d* is configured as a slanted surface coupling the end surface 83*h* of the narrow portion 82B of the stepped groove 80 and the straight portion 81 of the groove 80. A slanted surface 24*c* is provided at each of the side portions 24 of the other fuse 20 in correspondence to the tapered surfaces 83*c*, 83*d* shown in FIGS. 5 to 7.

When the other fuse 20 is attached to the fuse attachment portion 70 of the housing 59, the slanted surfaces 24*c* shown in FIGS. 5 and 6 of the side portions 24 of the other fuse 20 abut against the tapered surfaces 83*c*, 83*d* shown in FIG. 7 of the stepped portion 82 of the fuse attachment portion 70, whereby the insertion operation of the other fuse 20 into the fuse attachment portion 70 is stopped.

When the other fuse 20 is assembled to the housing 59, the slanted surfaces 24*c* provided at the side portions 24 of the other fuse 20 are aligned to the tapered surfaces 83*c*, 83*d* of the groove 80 of the housing 59 as shown in FIG. 7, so that the other fuse 20 can be surely fixed to the housing 59. The slanted surfaces 24*c* provided at the side portions 24 of the other fuse 20 abut against the tapered surfaces 83*c*, 83*d* of the groove 80 of the housing 59, whereby the other fuse 20 is positioned at and fixed to the housing 59.

Since each of the head portion 13 and the jig engagement portion 14*a* of the low-height fuse 10 having the different configuration from the other fuse 20 is not provided with a slanted surface, the low-height fuse 10 can be surely fixed to the stepped portion 82 of the groove 80 of the housing 59 without being influenced by the tapered surfaces 83*c*, 83*d* of the groove 80 of the housing 59.

The low-height fuse 10 or the high-height other fuse 20 may be assembled in an extremely inclined posture to the fuse attachment portion 70 of the housing 59. For example, the fuse 10 or 20 may be assembled to the fuse attachment portion 70 of the housing 59 while the terminal 15 or 25 of the fuse 10 or 20 contacts to a Ta portion which is a corner portion between the inclined guide surface 71*a* of opening portion 71 of the fuse attachment portion 70 and the wide portion 82A forming the stepped portion 82 of the groove 80.

Although depending on the degree of inclination of the low-height fuse when the low-height fuse 10 is assembled to the fuse attachment portion 70 of the housing 59, when the low-height fuse 10 is assembled to the fuse attachment portion 70 of the housing 59 while being inclined, the insulation housing 11 of the small-sized fuse 10 may contact to a Tb portion or a Tc portion which is a corner portion of the partition wall 65, for example, and may be inserted into the housing portion 72 of the fuse attachment portion 70.

Further, although depending on the degree of inclination of the other fuse when the high-height other fuse 20 is assembled to the fuse attachment portion 70 of the housing 59, when the high-height other fuse 20 is assembled to the fuse attachment portion 70 of the housing 59 while being inclined, the tip end portion 26 of the terminal 25 of the mini fuse 20 may contact to the Tj portion or the Tk portion of the positioning portion

83*d* of the stepped portion 82 forming the groove 80, for example, and so may be inserted into the straight portion 81 of the groove 80.

In this manner, when the low-height fuse 10 or the high-height other fuse 20 is assembled to the fuse attachment portion 70 of the housing 59, the fuse 10 or 20 is expected to be assembled to the fuse attachment portion 70 of the housing 59 while being inclined at various insertion angles. However, in this case, since the fuse 10 or 20 is assembled to the fuse attachment portion 70 of the housing 59 while being guided by the groove 80 of the side walls 61, 62 of the housing 59 or the partition wall 65 of the housing 59, such a phenomenon can be prevented from occurring. Accordingly, the movable arm portion 31 of the U-shaped terminal 30, to be conductively coupled to the terminal 15 or 25 of the fuse 10 or 20, will not be bent, such that a problem in the coupling state between the terminal 15 or 25 of the fuse 10 or 20 and the U-shaped terminal 30 will not occur.

When the aforesaid fuse cavity structure is applied to the electric connection box 1 shown in FIGS. 5 to 7, it is possible to provide the electric connection box 1 to which the low-height fuse 10 can be stably assembled. Further, when the aforesaid fuse cavity structure is applied to the electric connection box 1, it is possible to provide the electric connection box 1 to which at least two kinds of the fuses 10, 20 with different configurations can be stably assembled.

In the electric connection box 1, various electric and electronic parts such as an electronic unit (not shown) are housed. Such the electric connection box 1 is used as a junction box (J/B) connected to each electric wiring of, for example, a car. Further, the electric connection box can be used as, for example, a relay box (R/B).

As described above, according to the first aspect of the invention, the heat generated from the fusible element of the fuse is not blocked by the wall but can be released through air. Therefore, the occurrence of such the disadvantage that the heat generation of the fuse exerts the bad influence on the housing is prevented.

According to the second aspect of the invention, when the overcurrent is applied between the terminals of the fuse and the fusible element between the terminals is fused, the heat of the fusible element is directed to the air layer. Therefore, the heat release effect of the housing can be improved.

According to the third aspect of the invention, it is possible to provide the electric connection box that is superior in heat release effect.

As described above, according to the fourth aspect of the present invention, since the groove corresponding to the head portion of a fuse and the jig engagement portion is provided within the housing, the fuse can be stably assembled to the housing. Further, when a low-height fuse is employed, the head portion of the fuse is housed within the groove of the housing and so the head portion of the fuse is housed within the housing. Thus, a miniaturized fuse cavity structure can be provided.

According to the fifth aspect of the present invention, the fuse can be surely attached to the grooves provided within the housing. Further, the width of the jig engagement portion is made narrower than the width of the head potion of the fuse. Thus, when the fuse attached to the grooves is pulled out by means of a jig such as a fuse puller, for example, the jig such as the fuse puller is likely engaged at its tip end portion with the head portion and the jig engagement portion constituting the fuse. Thus, the fuse attached to the housing can be easily pulled out from the housing.

According to the sixth aspect of the present invention, at least two kinds of fuses, that is, at least the fuse and other fuse can be attached to the housing. For example, in recent years, it has been demanded to make it possible to attach various kinds of fuses to the housing, and to reduce a management cost by commonly using the parts thereby to reduce the cost of the parts. In this respect, when a plurality of the fuses with the different configurations are arranged to be able to be attached to the housing, the parts can be commonly used and hence the cost of the parts can be reduced.

According to the seventh aspect of the present invention, when the other fuse is assembled to the housing, the slanted surface provided at the side portion of the other fuse is aligned to the tapered surface of the groove of the housing, so that the other fuse can be surely fixed to the housing. Further, the fuse having the different configuration from the other fuse can be surely fixed to the groove of the housing without being influenced by the tapered surface of the groove of the housing.

According to the eighth aspect of the present invention, it is possible to provide the electric connection box to which fuse can be stably assembled. Further, when the fuse cavity structure according to the sixth or seventh aspect of the present invention is applied to the electric connection box, it is possible to provide the electric connection box to which at least two kinds of the fuses with different configurations can be assembled.

The invention claimed is:

1. A fuse cavity structure, comprising:

a housing provided with a plurality of fuse attachment portions divided by partition walls which extend substantially perpendicular from a bottom surface of the fuse attachment portions, a large-sized fuse and a small-sized fuse shorter than the large-sized fuse being attachable to the fuse attachment portions, wherein each of the fuse attachment portions are adapted to accommodate the large-sized fuse or the whole small-sized fuse, such that both fuse sizes are accommodated interchangeably in each fuse attachment portion, wherein a part of the partition wall which is opposed to a part of the small-sized fuse accommodated in the fuse attachment portion is cut to form a notch, the notch communicating adjacent fuse attachment portions to each other, wherein the notch is formed as a through-hole that is entirely bounded by the partition wall and the bottom surface of the fuse attachment portion.

2. An electric connection box comprising a fuse cavity structure, the fuse cavity structure including:

a housing provided with a plurality of fuse attachment portions divided by partition walls which extend substantially perpendicular from a bottom surface of the fuse attachment portions, a large-sized fuse and a small-sized fuse shorter than the large-sized fuse being attachable to the fuse attachment portions, wherein each of the fuse attachment portions are adapted to accommodate the large-sized fuse or the whole small-sized fuse, such that both fuse sizes are accommodated interchangeably in each fuse attachment portion, wherein a part of the partition wall which is opposed to a part of the small-sized fuse accommodated in the fuse attachment portion is cut to form a notch, the notch communicating adjacent use attachment portions to each other, and wherein the notch is formed as a through-hole that is entirely bounded by the partition wall and the bottom surface of the fuse attachment portion.

* * * * *